US006602007B1

(12) United States Patent
Majus

(10) Patent No.: US 6,602,007 B1
(45) Date of Patent: Aug. 5, 2003

(54) PIN TAPE FOR SCRAP REMOVAL

(76) Inventor: Robert E. Majus, 6302 Running Iron Dr., Crystal Lake, IL (US) 60012

( * ) Notice: Subject to any disclaimer, the term of this patent is extended or adjusted under 35 U.S.C. 154(b) by 0 days.

(21) Appl. No.: 10/127,127

(22) Filed: Apr. 19, 2002

(51) Int. Cl.[7] ..... B41J 11/26

(52) U.S. Cl. ..... 400/616; 400/616.2; 83/154; 493/373

(58) Field of Search ..... 400/616–616.3; 101/124, 125, 126; 83/154, 27; 493/373

(56) References Cited

U.S. PATENT DOCUMENTS 3,893,359 A * 7/1975 Gregoire ..... 83/154
4,846,030 A * 7/1989 McMahon et al. ..... 83/27
4,905,599 A * 3/1990 Richey ..... 101/226

OTHER PUBLICATIONS

The IBM Techinical Disclosure Bulletin, Continuous Paper Forms Severator, Sep. 1, 1962, NN620915, vol. No. 5, Issue No. 4, pp. 15–16.*

* cited by examiner

*Primary Examiner*—Andrew H. Hirshfeld
*Assistant Examiner*—Minh Chau
(74) *Attorney, Agent, or Firm*—Mathew R. P. Perrone, Jr.

(57) ABSTRACT

A pin tape has a series of pins mounted on a pin tape, which can then be releasably secured at a desired position in a printing process and produce more efficient collection of scrap paper, thereby enhancing the efficiency of the crane process.

18 Claims, 3 Drawing Sheets

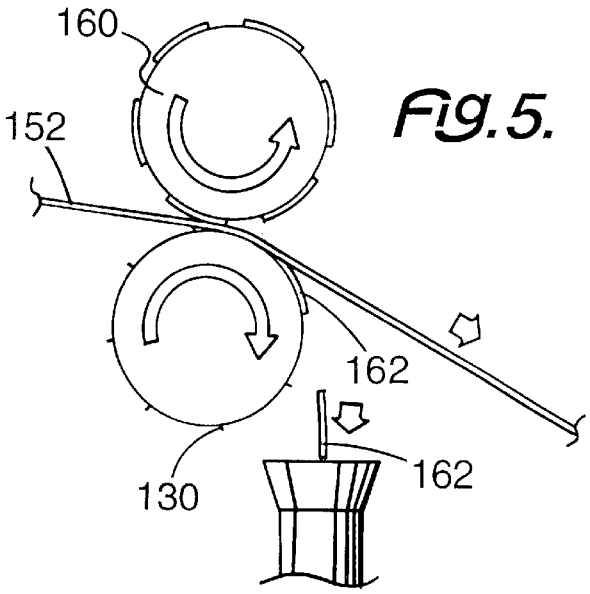
Fig.5.
Fig.6.
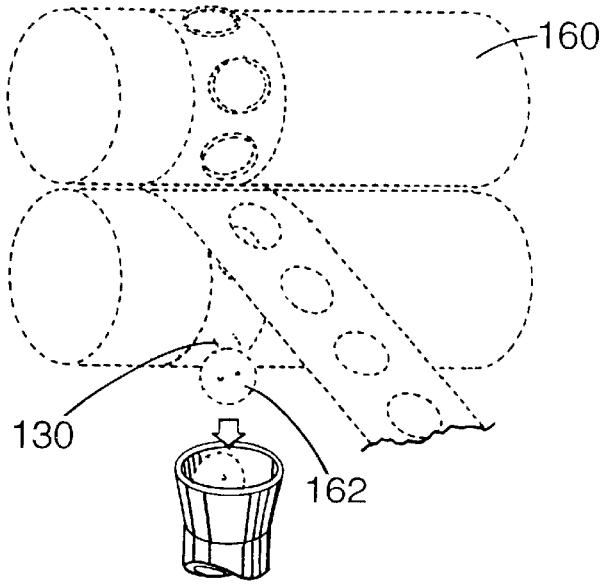

PIN TAPE FOR SCRAP REMOVAL

This invention relates to a scrap removing device and more particularly to a pin tape for scrap removal, which easily cooperates with a die cutting assembly in order to provide a finishing process useful in the printing industry.

BACKGROUND OF THE INVENTION

In the printing industry, the finishing process for printed work is critical. After the printing is complete, the printed product is passed to a die cutting assembly. This die cutting assembly shapes the edge of the printed product. The die cutting assembly provides the finishing step for the printing process, and can be accomplished in either a continuous in line finishing step, or a discontinuous off line finishing step. The discarded paper, which results from the cutting assembly, can cause problems in the entire frame process.

More particularly, with a printing press which uses a lot of continuous paper feed as the paper is received, it is often desired to provide a specific shape for the edge of the paper being printed. A typical desired edge can include a jagged edge, a zigzag edge, a punched edge, or any other desired shape. Such edges can provide for desired type of bonding in order to secure a plurality of printed pages together.

Production of the desired edge for a printed product causes scrap paper. It is desired to efficiently remove any scrap paper, such as continuous dies or die chips, from the desired product. Continuous dies are generally formed when a specific paper edge is desired. Die chips are formed when specific punch or aperture in the paper is desired, and are usually discontinuous waste. Such an aperture or a series thereof may be used for joining a plurality of sheets of paper together.

However, scrap paper, such as the continuous dies or die chips, must be controlled. If such scrap paper is not controlled, a cluttered, trashy appearance can occur. Scrap paper can accumulate in other pieces of equipment farther down the process in the finishing line. Such accumulation does create stoppages in production and increases paper waste, due to excessive startups. It is very desirable to efficiently collect that scrap paper, and remove it and organized, repetitive manner.

Such scrap paper can also interfere with the efficient running of equipment used to process the paper, while forming a desired product. As the paper is printed, the scrap paper can also reach the surface to be printed and impair the printing of a proper document.

In a typical manufacturing process, which forms continuous dies (or scrap) as the printing, especially the finishing process for the printing process takes place, scrap must be efficiently removed in a continuous fashion. Otherwise, the scrap will get into the area of the process, from which the desired product must be recovered. Such scrap can foul the machinery, to a point where the manufacturing process is slowed or even stopped. The undesirable results also occur with die chips. If continuous dies or die chips can be efficiently removed from the processing area, speed of processing can be maintained, without any other sacrifice.

Directing the dies or the die chips to a desired area is difficult. Some devices for doing so require substantial modification of the printing press, and various components associated with the press. Such devices clearly add complexity and costs to the printing process. Not only is the equipment expensive, it is also difficult to maintain.

Mechanical attachments or electrical attachments, adapted to remove the die chips or continuous dies, greatly complicate the printing process. Not only is more space taken up, more complications are added to the machinery. These complicated devices also suffer breakdowns and slow the printing process.

Furthermore, it is clear that this loose paper or scraps in the form of die chips or continuous chips, floats around an area and can cause pollution problems. It is always desired to minimize pollution. However, the device, which minimizes pollution, in an inexpensive and efficient fashion is even more valuable.

If directing of the dies or die chips can be accomplished in a simple fashion without making substantial modifications of existing equipment, while at the same time providing for ease of installation, great advantages are accomplished. Not only are costs reduced, but the efficiency of the printing process is greatly enhanced.

SUMMARY OF THE INVENTION

Among the many objectives of this invention is the provision of a pin tape, which is easily attached to a finishing device used in a printing process.

A further objective of this invention is the provision of a pin tape, which easily removes continuous dies.

Yet a further objective of this invention is the provision of a pin tape, which easily removes die chips.

A still further objective of this invention is the provision of a pin tape which reduces printing process shutdowns.

Another objective of this invention is the provision of a pin tape, which is easily retrieved.

Yet another objective of this invention is the provision of a pin tape, which is easily attached.

Still, another objective of this invention is the provision of a pin tape, which directs continuous dies to a desired position.

Also, an objective of this invention is the provision of a pin tape, which directs die chips to a desired position.

A further objective of this invention is the provision of a pin tape, which avoids mechanical attachments.

Yet a further objective of this invention is the provision of a pin tape, which avoid electrical attachments.

A still further objective of this invention is the provision of a pin tape, which minimizes pollution.

Another objective of this invention is the provision of a pin tape, which reduces production down time.

Yet another objective of this invention is the provision of a pin tape, which reduces paper waste.

These and other objectives of the invention (which other objectives become clear by consideration of the specification, claims and drawings as a whole) are met by providing a pin tape, which can be releasably secured at a desired position on a finishing device in a printing process and produce more efficient collection of scrap paper.

BRIEF DESCRIPTION OF THE DRAWINGS

FIG. 5 depicts a side view of pin tape 100 of this invention in use with die chips 162.

FIG. 6 depicts a perspective view of pin tape 100 of this invention in use with die chips 162.

Throughout the figures of the drawings, where the same part appears in more than one figure of the drawings, the same number is applied thereto.

DESCRIPTION OF THE PREFERRED EMBODIMENTS

Figure 1:
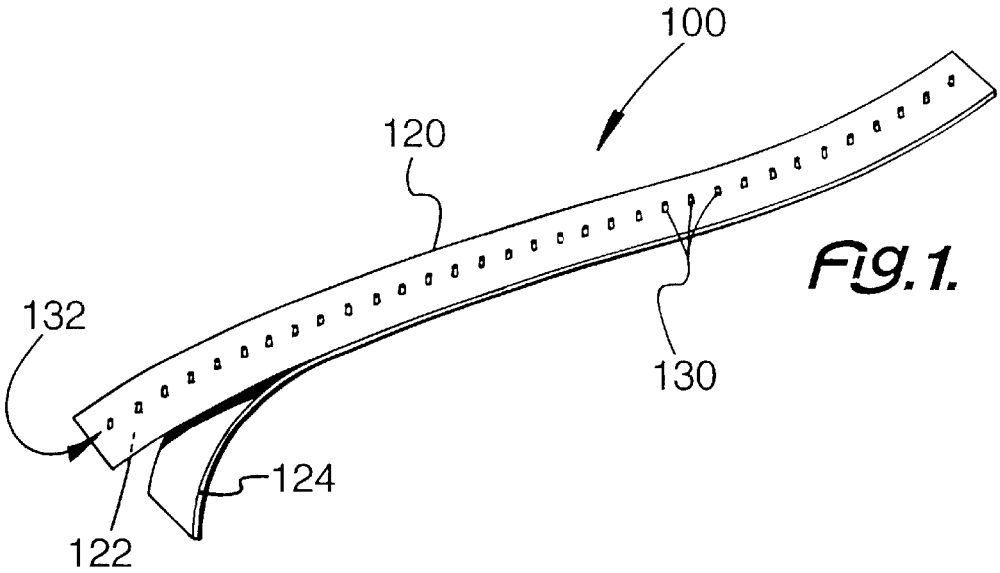
FIG. 1 depicts a perspective view of pin tape 100 of this invention.

With a pin tape of this invention, a strip of material is provided. The strip of material has a plurality of pins protruding therefrom. The strip of material and its pins may be secured around a desired roller in a printing process. More particularly, the pin tape is fitted around a roller in a finishing device for a printing process.

As paper is printed, sometimes the edge of the paper is cut to a desired pattern. It is desired to remove the cut material from the work area and collect the same for recycling in an efficient manner. With the pins protruding upwardly from the roller, the cut material is captured thereby and directed to an appropriate removal site.

In a preferred form, the cut material, which is usually in the form of continuous dies or die chips, is captured on the pins and removed therefrom by a vacuum hose. The vacuum hose collects the cut material or waste or scrap, and directs it to the desired collection area.

Any suitable flexible strip of material can be used to support the pin. The flexible strip supporting the pins may be paper, metal, or plastic. The flexible strip must support the pins and be capable of withstanding the rigors of the printing system.

The strip of material is preferably steel with adhesive on one side of the steel. The series of pins protrudes above the surface of the steel on the side oppositely disposed from the adhesive. With the strip of steel being used, it is also preferred to have the pins in alignment along the strip.

Thus, a cover sheet for the adhesive on the strip is removed therefrom. At that point, the strip may be releasably adhered to a roller for a print finishing device in a desired position. While the strip is in place, the pins catch the paper waste and move the same to a collecting device such as a vacuum hose. With the pins directing the waste to the vacuum hose, it becomes less likely for the waste to settle on the desired printing surface, and foul the printing surface or the press itself.

Thus it is clear that the finishing step for the printing process, and can be accomplished in either a continuous in line finishing step, or a discontinuous off line finishing step. The pin tape can be used to help collect discarded scrap or paper, such as the continuous dies or die chips, which results from the cutting assembly.

The finishing step, using a pin tape of this invention, of course, is accomplished by any standard finishing device. This finishing device can be connected right to the printing press for an in line finishing step. The finishing device may also not be connected to the printing press, so that the printed material must be transported to the finishing device, for an off line finishing step. The off line finishing step may take place anywhere, after printing is accomplished, even in another building.

In a preferred form, the length of the pins is about 90 percent to about 120 percent based on the thickness of the steel or other strip being used. More preferably, the length of the pins is about 95 percent to about 110 percent based on the thickness of the steel being used. Most preferably, the length of the pins is about 99 to about 105 percent based on the thickness of the steel being used.

Alternatively with another preferred form, the length of the pins can be based on the thickness of the paper being printed. Preferably, is about 90 percent to about 120 percent based on the thickness of the paper being printed. More preferably, the length of the pins is about 95 percent to about 110 percent based on the thickness of the paper being printed. Even more preferably, the length of the pins is about 99 to about 105 percent based on the thickness of the steel being used. Most preferably, the length of the pins is about the same as the thickness of the paper being printed.

The strip, which supports the pins, may have any suitable length for its purpose so that the strip may fit around the roller. The width of the strip must be sufficient to support the pins. Preferably, the strip is up to about three centimeters wide. More preferably, the strip is about 0.5 centimeter to about three centimeters wide. Most preferably, the strip is about one centimeter to about two centimeters wide.

While the pins may be positioned in any suitable position on the flexible strip, a preferred positioning for the pins is may well be adapted to the shape of continuous dies or die chips. A linear pin arrangement along the linear axis of the flexible strip. A zig zag pattern for the pins, as well as square or other geometrical shape is operable. Other positioning is feasible if desired. Such other positioning can be related to the continuous dies or die chips and the respective shapes thereof.

Referring now to FIG. 1, pin tape 100 includes a flexible strip 120 with a plurality of pins 130 extending upwardly therefrom. In Figure, pins 130 are linear along the longitudinal axis of flexible strip 120. More particularly, pins 130 preferably fall on line 132. Oppositely disposed from the pins 130 is an adhesive back 122 for strip 120. Adhesive protector 124 is releasably attached to adhesive back 122 and may be removed when use of the pin tape 100 is desired.

Figure 2:
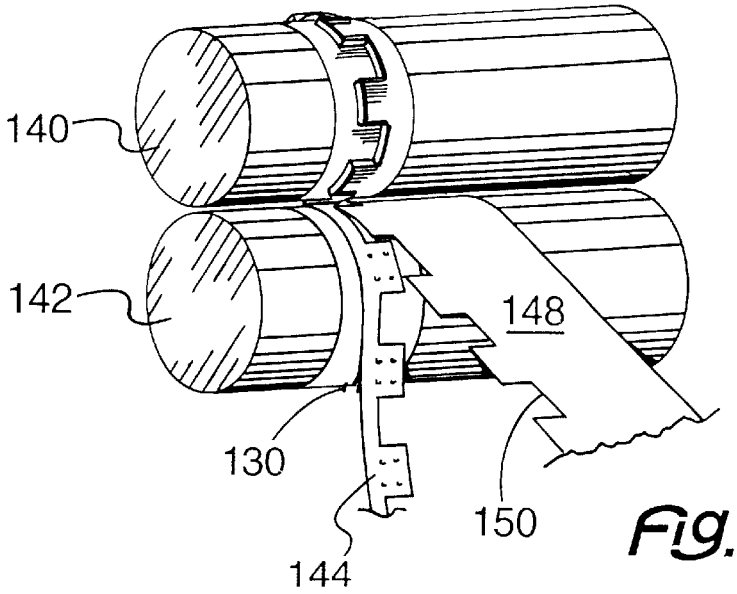
FIG. 2 depicts a perspective view of the pin tape 100 of this invention in use.

Adding FIG. 2 to the consideration, pin tape 100 is secured to the anvil cylinder 140 in a standard press unit (not shown). Anvil cylinder 140 contacts die cylinder 142. Anvil cylinder 140 and die cylinder 142 cooperate to provide continuous chips 144. Pins 130 capture continuous chips 144 (FIG. 3) and separate them from paper web 148 in order to form desired web edge 150. Pins 130 are shown in a square pattern.

Figure 3:
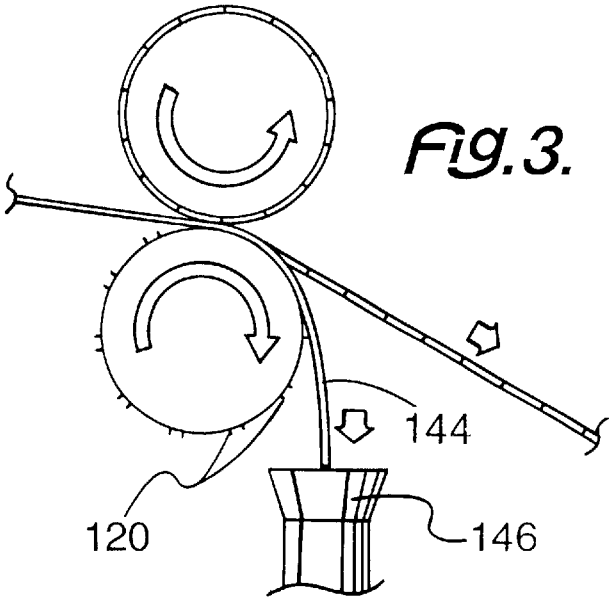
FIG. 3 depicts a side view for the pin tape 100 in use continuous chips 144.
Figure 4:
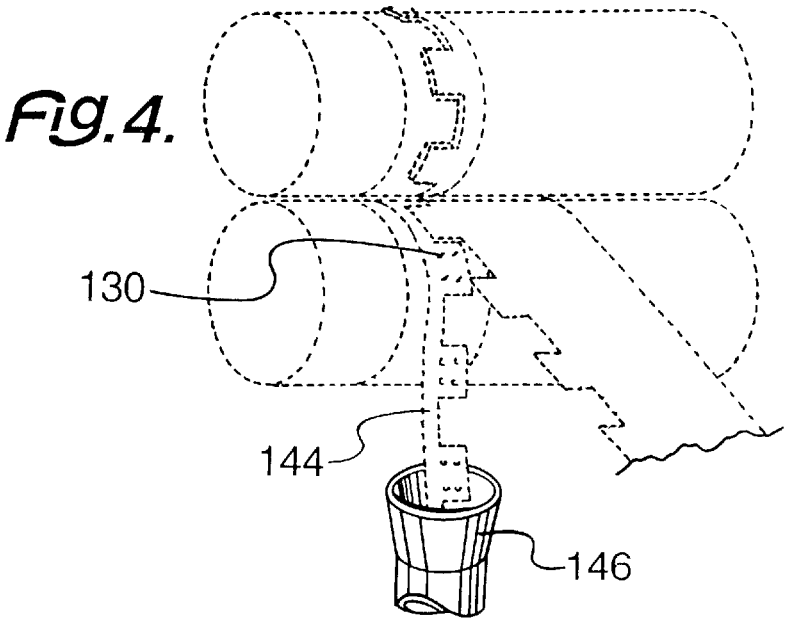
FIG. 4 depicts a perspective view of pin tape 100 of this invention in use with continuous chips 144.

With FIG. 3 and FIG. 4 added to the consideration, it becomes clear that the scrap in the form of continuous chips 144 may be collected by a vacuum hose 146 and directed to as proper area for disposal. Such a structure with the control of the scrap provided by pins 120 permit a clean work area and environmentally improved conditions.

Considering now FIG. 5 and FIG. 6, die cylinder 142 of FIG. 2 is replaced with chips cutting cylinder 160. Chips cutting cylinder 160 punches a series of desired apertures in the paper 152 being printed. In the same manner, pins 130 collect die chips 162 which are also directed to vacuum hose 146 as desired. Clearly chips cutting cylinder 160 can be adapted to provide any suitable aperture or shape of die chips 162.

Pins 130 have a paired pattern shown in FIG. 6. Clearly, any desired pattern is operable, depending on the scrap being formed. With vacuum hose 146, any scrap paper is easily collected and recycled.

This application—taken as a whole with the abstract, specification, claims, and drawings being combined—provides sufficient information for a person having ordinary skill in the art to practice the invention as disclosed and claimed herein. Any measures necessary to practice this invention are well within the skill of a person having ordinary skill in this art after that person has made a careful study of this disclosure.

Because of this disclosure and solely because of this disclosure, modification of this method and device can become clear to a person having ordinary skill in this particular art. Such modifications are clearly covered by this disclosure.

What is claimed and sought to be protected by Letters Patent of the United States is:

1. A pin tape for use with a finishing step in a printing process comprising:

(a) a flexible strip having a plurality of pins protruding therefrom;

(b) the flexible strip being securable to a finishing device for a printing process;

(c) the flexible strip having a length for the strip to fit the finishing device;

(d) the flexible strip having a width sufficient to support the pins;

(e) the flexible strip having a width of up to about three centimeters;

(f) each member of the plurality of pins having a length based on a thickness of paper being printed;

(g) each member of the plurality of pins having a length about 90 percent to about 120 percent based on the thickness of paper being printed;

(h) the flexible strip being steel;

(i) the flexible strip having an adhesive side and a pin side oppositely disposed from the adhesive side;

(j) the advise side being adherable to the finishing device; and (k) the plurality of pins being on the pin side.

2. The pin tape of claim 1 further comprising:

(a) the flexible strip being about one centimeter to about two centimeters wide; and (b) the length of the pins being about 99 to about 105 percent based on the thickness of paper being printed.

3. In a printing assembly having a printing press cooperating with a finishing device, the improvement comprising:

(a) a pin tape being usable with the finishing device;

(b) the pin tape including a flexible strip with a plurality of pins protruding therefrom;

(c) the flexible strip being secured to the finishing device for the printing assembly in order to remove a set of scrap paper from the finishing device;

(d) the flexible strip having a length for the strip to fit the finishing device;

(e) the flexible strip having a width sufficient to support the pin;

(g) the flexible strip being steel;

(h) the flexible strip having an adhesive side and a pin side oppositely disposed from the adhesive side;

(i) the adhesive side being adherable to the finishing device; and (j) the plurality of pins being on the pin side.

4. The printing assembly of claim 3 further comprising:

(a) the flexible strip being up to about three centimeters wide; and (b) the length of each pin in plurality of pins is about 95 to about 120 percent based on the thickness of paper being printed.

5. The printing assembly of claim 4 further comprising:

(a) the flexible strip being about 0.5 centimeter to about three centimeters wide; and (b) the length of each pin in plurality of pins being about 95 to about 110 percent based on the thickness of paper being printed.

6. The printing assembly of claim 5 further comprising:

(a) the flexible strip being about one centimeter to about two centimeters wide; and (b) the length of each pin in plurality of pins being about 99 to about 105 percent based on the thickness of paper being printed.

7. The printing assembly of claim 6 further comprising:

(a) a vacuum means being adapted to receive a set of scrap paper; and (b) the flexible strip being secured around a roller of the finishing device for the printing assembly in order to remove the set of scrap paper from the finishing device.

8. The printing assembly of claim 7 further comprising the set of scrap paper being substantially continuous dies.

9. The printing assembly of claim 7 further comprising the set of scrap paper being substantially discontinuous die chips.

10. The printing assembly of claim 7 further comprising the finishing device with the pin tape being off line.

11. The printing assembly of claim 7 further comprising the finishing device with the pin tape being in line.

12. In a printing process having a printing press cooperating with a finishing device, the improvement comprising:

(a) adding a pin tape to the finishing device;

(b) collecting scrap from the finishing device on the pin tape;

(c) removing the scrap from the pin tape;

(d) collecting the scrape;

(e) providing the pin tape with a flexible strip;

(f) providing an adhesive side for the flexible strip;

(g) protecting the adhesive side with a removable protector;

(h) providing a pin side for the flexible strip oppositely disposed from the adhesive side; and (i) providing a plurality of pins being on the pin side.

13. The printing process of claim 12 further comprising:

(a) the flexible strip being up to about three centimeters wide; and (b) the length of each pin in plurality of pins is about 95 to about 120 percent based on the thickness of paper being printed.

14. The printing process of claim 13 further comprising:

(a) the flexible strip being about 0.5 centimeter to about three centimeters wide; and (b) the length of each pin in plurality of pins being about 95 to about 110 percent based on the thickness of paper being printed.

15. The printing process of claim 14 further comprising:

(a) the flexible strip being about one centimeter to about two centimeters wide; and (b) the length of each pin in plurality of pins being about 99 to about 105 percent based on the thickness of paper being printed.

16. The printing process of claim 15 further comprising:

(a) a vacuum means being adapted to receive a set of scrap paper; and (b) the flexible strip being secured around a roller of the finishing device for the printing assembly in order to remove the set of scrap paper from the finishing device.

17. A pin tape for use with a finishing step in a printing process comprising:

(a) a flexible strip having a plurality of pins protruding therefrom;

(b) the flexible strip being securable to a finishing device for a printing process;

(c) the flexible strip having a length for the strip to fit the finishing device;

(d) the flexible strip having a width sufficient to support the pins;

(e) the flexible strip having a width of up to about three centimeters;

(f) each member of the plurality of pins having a length based on a thickness of paper being printed; and (g) each member of the plurality of pins having a length about 90 percent to about 120 percent based on the thickness of paper being printed;

(h) the flexible strip having an adhesive side and a pin side oppositely disposed from the adhesive side;

(i) the adhesive side being adherable to the finishing device; and (j) the plurality of pins being on the pin side.

18. The pin tape of claim 17 further comprising:

(a) the flexible strip being about one centimeter to about two centimeters wide; and (b) the length of the pins being about 99 to about 105 percent based on the thickness of paper being printed.

* * * * *